United States Patent [19]

Pistner

[11] Patent Number: 4,790,437

[45] Date of Patent: Dec. 13, 1988

[54] THERMOPLASTIC BAG, BAG PACK AND METHOD OF MAKING THE SAME

[75] Inventor: Timothy W. Pistner, Fairport, N.Y.

[73] Assignee: Mobil Oil Corporation, New York, N.Y.

[21] Appl. No.: 675,109

[22] Filed: Nov. 26, 1984

[51] Int. Cl.[4] ..... B65D 30/08; B65D 33/10; B65D 69/00

[52] U.S. Cl. ..... 206/554; 383/8; 383/120; 383/122; 383/903

[58] Field of Search ..... 206/390, 449, 494, 526, 206/554, 452, 806; 383/8, 17, 122, 903, 120

[56] References Cited

U.S. PATENT DOCUMENTS

| | | | |
|---|---|---|---|
| 1,663,391 | 3/1928 | Shaffer et al. | 206/494 |
| 2,819,834 | 1/1958 | Brady | 383/120 |
| 2,915,098 | 12/1959 | McKay, Jr. et al. | 383/120 |
| 3,485,439 | 12/1969 | Shrvm | 383/120 |
| 3,533,331 | 10/1970 | Kugler | 206/390 |
| 3,670,953 | 6/1972 | Leventhal | 383/120 |
| 3,685,643 | 8/1972 | Garshelis | 206/499 |
| 3,758,024 | 9/1973 | Bethke et al. | 383/120 |
| 3,834,528 | 9/1974 | Pickford et al. | 206/526 |
| 3,966,524 | 6/1976 | Lehmacher | 206/390 |
| 4,476,979 | 10/1984 | Reimann et al. | 383/9 |
| 4,508,222 | 4/1985 | Choe | 206/390 |

FOREIGN PATENT DOCUMENTS

| | | | |
|---|---|---|---|
| 2526961 | 5/1976 | Fed. Rep. of Germany | 383/8 |
| 43930 | 3/1971 | Finland | 383/8 |

*Primary Examiner*—Stephen Marcus
*Attorney, Agent, or Firm*—Alexander J. McKillop; Michael G. Gilman; James P. O'Sullivan, Sr.

[57] ABSTRACT

A method for forming a thermoplastic film handled bag comprising: forming a continuous collapsed thermoplastic tube having heat seal lines across the width of said tube at bag length intervals, longitudinally folding opposite sides of the heat sealed tube equally towards each other until they meet at a common center line, folding the structure once again in the same direction along said center line and removing eight film layers in one of the corner regions defined by a heat seal line and the spine of the common center line fold, the film removal yielding a bag mouth opening and single loop handles at near the opposite ends of said bag mouth opening. Interconnected bags can be formed into a roll pack or individually severed bags can be unitized into a bag pack.

9 Claims, 1 Drawing Sheet

THERMOPLASTIC BAG, BAG PACK AND METHOD OF MAKING THE SAME

This invention is concerned with a thermoplastic handled sack, a plurality of said sacks unitized into a bag pack and a method for preparing the same.

BACKGROUND OF THE INVENTION

Handled thermoplastic sacks are well known and are finding increasing use in the grocery sack market. Far and away the most common type of thermoplastic handled grocery sack is one made from a gusseted tube sealed at the top and the bottom, with a suitable bag mouth and handle cut-out, which yields a double layer of film in the handled region. There are problems associated with this type of bag. One problem is the fact that the gusset folds of the bag are of necessity trapped in the bottom seal of the bag. This prevents the gusset from extending fully as product is loaded into the bag, which results in a wasteful loss of volume. Another problem is that where there are transitions from four layers to two layers along the heat seal line of the bottom of the bag and forces are brought to bear at these transition points as the bag attempts to expand, tears develop on both sides of the bag at the transition points.

It is an object of the present invention to provide a bag and a method of making the same which bag will have-maximum volumetric efficiency.

It is an object of the present invention to provide a continuous method of making bags characterized by simplicity and efficiency which method avoids or overcomes the above-mentioned problems.

SUMMARY OF THE INVENTION

The present invention is directed to a method for forming thermoplastic film handled bags comprising:

(a) forming a continuous collapsed thermoplastic film tube;

(b) forming heat-seal lines across the width of said tube, transverse to the tube sides, at bag length intervals, said heat-seal lines being sufficient to seal the films of said collapsed tube together and preweaken said line for subsequent bag separation;

(c) longitudinally folding opposite sides of the heat sealed tube equally toward each other until they at least substantially meet at a common center line;

(d) folding this structure once again along said center line so as to bring the folded opposite sides into face-contact;

(e) removing eight film layers in one of the corner regions defined by a transverse heat-seal and the spine of fold (d), the film removal being such as to yield, on unfolding, a bag having a bag mouth opening and single film loop handles near opposite ends of said bag mouth opening but spaced from the bag sides; and (f) collecting, while still folded, the interconnected structures of (e) into a volumetrically efficient pack of bags.

The bags can be formed in a continuous top-to-top and bottom-to-bottom relationship or in a top-to-bottom relationship and the resultant interconnected bags collected in a roll for individual dispensing.

Alternatively, the bags can be formed into discrete, separated bags having detachable tab members in the bag mouth region so that a plurality of stacked bags can be unitized by way of the detachable tab.

The invention is also directed to a thermoplastic bag structure comprising a front and rear bag wall, a bottom and an open mouth top portion, said open mouth portion being characterized by having loop handles near opposite ends of the bag mouth but spaced from the bag sides. The bag is ungusseted along its sides and the bottom is heat sealed through two, four or eight layers of film.

DETAILED DESCRIPTION OF THE INVENTION

It is well known in the plastics film art to continuously melt extrude thermoplastic resin through an annular orifice, apply internal fluid pressure, e.g. air, to the tube thus extruded and thereby expand the tube and reduce the wall thickness thereof to appropriate dimensions while cooling and solidifying the extruded thermoplastic film. This technique and any equivalent technique for forming a thermoplastic film tube can be employed in providing the starting material for the bags and bag packs of the present invention.

The contemplated thermoplastic film can be of any type having the characteristics necessary for a handled bag required to carry items totaling up to 45 lbs. or more. While not limited to the polyolefins, these materials have proven in the past to be excellent, inexpensive films from which handled bags can be made. Preferred materials include polyethylene generically and specifically, low density polyethylene, high density polyethylene, including high molecular weight high density polyethylene, linear low density ethylene copolymerized with a $C_3$–$C_8$ alpha olefin and blends and mixtures of the foregoing materials. A specific example of a commercially available polyethylene material suitable for use in the present invention is a linear low density ethylene copolymerized with from about 2 to about 7 wt. % of octene-1. This linear low density ethylene-octene-1 copolymer, i.e. LLDPE can be melt extruded through an annular orifice and blown up to a tube which will have a lay flat dimension of approximately 19.5 inches. This tube is then collapsed and can serve as an example of the starting material for the present invention.

Figure 1:
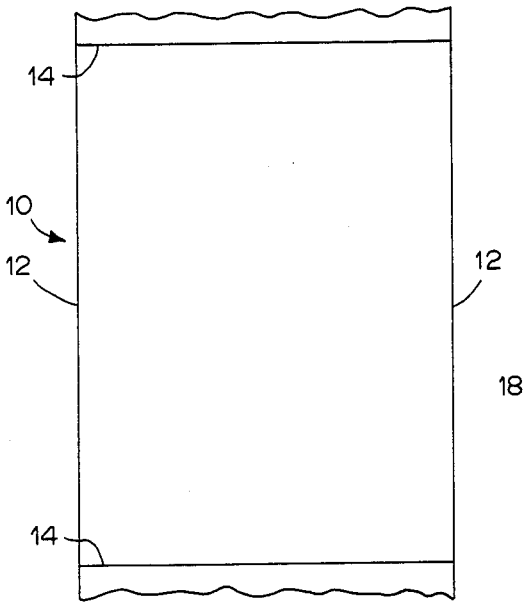
FIG. 1 is a plan vie w of a collapsed thermoplastic tube.

Referring to the drawing, a segment 10 of such a collapsed tube is shown in FIG. 1. The sides 12 are seamless and opposite ends 14 are heat sealed. In an automatic system, the continuously advancing collapsed tube will have spaced heat seal lines, such as at 14, impressed into the tube. The distance between heat seals will correspond to the distance between the heat seal at the top of the handle loop of a finished bag to the bottom heat seal of the bag. Obviously, this distance will vary depending upon the size of the desired bag. The type of seal contemplated is designed to heat weld the two films together without severing through the films. Such a heat seal can be controlled to effectively heat seal the films and just preweaken them so that subsequent separation along the heat seal line can be effected with little force. Such a seal will permit the segments to remain in linked connection through the remainder of the bag making process and also, if desired, to link the completed bags by way of this preweakened region while collected in a volumetrically efficient bag pack.

Figure 2:
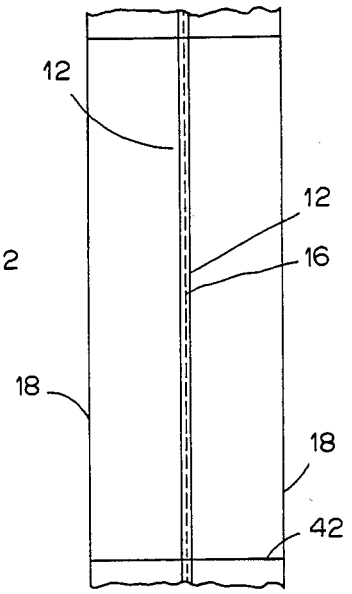
FIG. 2 is a plan view of the sealed tube of FIG. 1 with opposite sides folded equally inwardly.

FIG. 2 shows the sealed tube of FIG. 1 with the sides 12 folded toward each other so that they just contact each other at a common midline 16. As the flattened and sealed tube of FIG. 1 advances in an automatic system, a conventional turning and folding plate can automatically bring tube edges 12 together at the common midline 16. In like manner, as the folded structure of FIG. 2 progresses in the automatic system, a second folding plate will again longitudinally fold the structure of FIG. 2 upon itself so that the common midline 16 becomes the outer spine of the fold 16 of FIG. 3. The term "spine" is employed herein in the same sense as that in describing the "spine" of a book. In this same sense the outer fold lines 18 of FIG. 2 would be equivalent to the outer edges of the cover of a book hinged at a spine.

Figure 4:
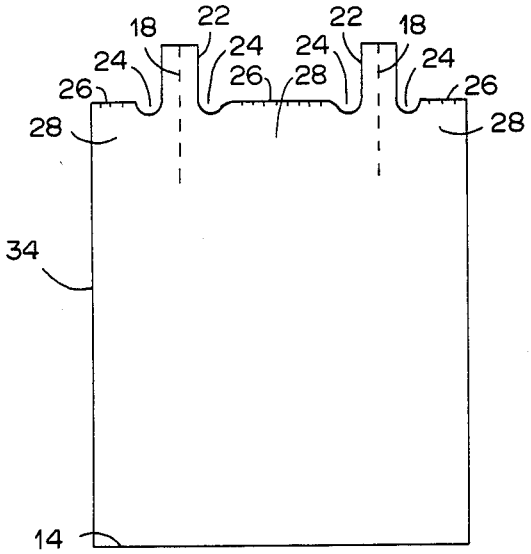
FIG. 4 is a single detached bag fully unfolded to show the handles and bag mouth regions of a bag.
Figure 3:
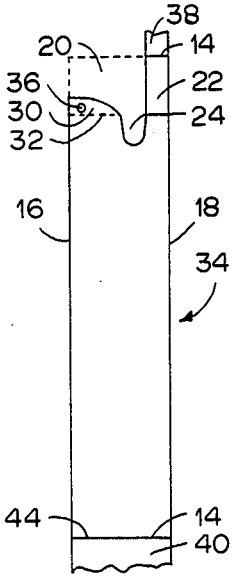
FIG. 3 is a plan view of the structure of FIG. 2 folded again along its centerline and revealing a handle and bag mouth region.

While in this double-folded condition with folded opposite sides in face-contact, the handles and bag mouth region of individual bags can be formed. In this folded condition, the structure consists of eight layers of film. The handles and bag mouth opening can be formed by removing eight film layers in one of the corner regions defined by one of the transverse heat seal lines 14 at its intersection with spine line or midline 16. This region is shown in FIG. 3 at region 20. The shape of the removed region 20 will dictate the shape of the handles and the bag mouth opening. As illustrated in FIG. 3 and FIG. 4, the shape of the eight films removed resulted in straight handles 22 and arcuate stress relief regions 24. It will be noted that in FIG. 3 two handles 22 are simultaneously formed during the eight film cut-out procedure. Each handle 22 in FIG. 3 is actually folded in two along line 18. In FIG. 4, the handles are shown in their unfolded condition with dotted line 18 representing the midline of the handle. Thus, by this technique double the amount of film as is shown in FIG. 3 is available in the handle. This provides the equivalent of the same amount of film that is employed in typical side gusseted double film handled bags. Consequently, the bag of the present invention can carry the same amount of weight as a side gusseted bag.

The arcuate stress relief regions 24 located at the base of the handles, function to transmit stress lines that would normally be concentrated at the bag mouth lines 26 to a position somewhat below this level. Thus, stress forces caused either by opening the bag during loading or after loading will by virtue of the arcuate stress relief regions, be directed to broad areas across regions 28. In this manner any preweakend regions in the bag mouth opening caused by perforation tears will be avoided.

Referring again to FIG. 3, the area 20 removed to form the bag mouth opening and the handles also can form tab members 30 detachably attached by way of perforations 32 to folded bag member 34. These tab members can be employed to unify a plurality of individual bags 34 stacked in registration. For example, 50 to 100 of the bags can be stacked in registration and an appropriate heat seal means can fuse the tabs together forming a unified pack. FIG. 3 shows an orifice 36 pierced through tab members 30. A hot piercing device can melt a hole through all of the tabs, heat seal unifying the tabs and simultaneously forming therein orifice 36. This orifice can be employed to suspend the resulting pack so that bags can be torn from the pack one at a time.

Alternatively, in place of tab members 30, the bags may remain interconnected at heat seal 14 and the bags may be convolutely rolled into a suitable pack for later dispensing one at a time by tearing the bags free of the roll along lines 14. Instead of a roll the bags can be folded back and forth one upon the other in a zig-zag type arrangement.

While one bag member at a time can be formed by sequential removal of regions 20 of the folded structure, it may be found to be more expeditious to employ a film cutting member which forms bags arranged in a handle to handle and bottom to bottom relationship. In FIG. 3, there is shown a fragment 38 of the handle of an adjoining bag structure which would be formed simultaneously with the formation of bag 34. Bag fragment 40 of FIG. 3 illustrates the bottom of another adjoining bag formed just prior to bag 34.

As previously indicated, FIG. 4 illustrates an individual bag torn from a pack unitized by way of tabs 30 or by way of a series of bags interconnected by preweakened heat seal lines 14. FIG. 4 shows the bag in its fully unfolded layflat condition. This bag is unencumbered by trapped gussets in the bottom region along heat seal line 14 and thus can expand to its full potential volume.

A cutting mechanism employed for forming the handles and bag mouth opening can be of conventional design which can be mounted in suitable stamping apparatus. Such a cutting mechanism can have a continuous or discontinuous sharp cutting edge capable of shearing through multiple thicknesses of film. As a part of such a cutting mechanism, piercing knives can simultaneously form a line of perforations such as that illustrated at 32 in FIG. 3. Furthermore, as part of this cutting and perforation action, the unitizing step of heat piercing tab 30 can be performed during the same overall operation.

When extremely thin gauge film, i.e. from about 0.25–0.75 mil, is employed, the seal in the bottom of the bag can be reinforced by providing a second heat seal line 42 of FIG. 2. Which will seal four layers of film together. For further reinforcing the second heat seal line may be line 44 coincident with line 14 of FIG. 3. In this case line 44 would be heat sealing eight layers of film together. Such additional heat seal lines can seal and sever through the structure or merely heat seal and preweaken it for subsequent separation. Thin gauge bags of this type can be conveniently employed as container liners. With such use the handles may be draped over the container and employed to facilitate removal of the liner from the container and for tying the liner closed after removal.

What is claimed is:

1. A bag structure made of a thermoplastic film comprising a front and rear bag wall, a bottom and an open mouth top portion, said open mouth portion being characterized by having a single film loop handles near opposite ends thereof, said bag having seamless ungusseted sides, said bag being folded so that said sides meet at a common center line, the bottom of said bag being heat sealed through four layers of film, said bag being folded again along a line coincident with said center line so that said handles are in registration.

2. A bag structure made of a thermoplastic film comprising a front and rear bag wall, a bottom and an open moth top portion, said open mouth portion being characterized by having a pair of single film loop handles near opposite ends theroef; and at the base of each handle, on each side thereof there are arcuate stress relief regions and the upper edges of said mouth extend above said stress relief regions said bag having the sides equally folded toward each other to a point of contacting at a common midline, said bag being folded again along said midline so that said handles are in registration and the same relationship as when they were formed.

3. The bag of claim 2 having a detachable tab attached to said bag mouth opening.

4. A pack of bags comprising a stack of bags as defined in claim 3 with said tabs in registration, said stack being unitized by means fastening said tabs together.

5. The pack of bags of claim 4, each bag of which has a bottom sealed through two layers of film.

6. The pack of bags of claim 4, each bag of which has a bottom sealed through eight layers of film.

7. A roll pack of bags of claim 4, each bag of which has a bottom sealed through eight layers of film.

8. A roll pack of bags comprising a plurality of bag structures, as defined in claim 2, said bags being interconnected by way of preweakened heat sealed stripes transverse of said bags, said bags being convolutely rolled into a volumetrically efficient roll pack.

9. A pack of thermoplastic bags comprising a plurality of bag structures as defined in claim 2, said bags being interconnected by way of preweakened heat sealed stripes transverse of said bags, said bags being folded alternatively back and forth upon themselves to form a volumetrically efficient bag pack.

* * * * *

UNITED STATES PATENT AND TRADEMARK OFFICE

CERTIFICATE OF CORRECTION

PATENT NO. : 4,790,437

DATED : December 13, 1988

INVENTOR(S) : Timothy W. Pistner

It is certified that error appears in the above-identified patent and that said Letters Patent is hereby corrected as shown below:

Column 6, line 2, (claim 6), delete "eight" and insert --four--.

Signed and Sealed this

Seventh Day of May, 1991

*Attest:*

*Attesting Officer*

HARRY F. MANBECK, JR.

*Commissioner of Patents and Trademarks*